United States Patent [19]

Takahashi et al.

[11] Patent Number: 4,869,856

[45] Date of Patent: Sep. 26, 1989

[54] METHOD FOR PRODUCING CARBON FIBERS FROM ACRYLONITRILE FIBER STRANDS

[75] Inventors: Hayashi Takahashi; Tadasu Yagi, both of Shizuoka, Japan

[73] Assignee: Toho Rayon Co., Ltd., Tokyo, Japan

[21] Appl. No.: 82,469

[22] Filed: Aug. 7, 1987

[30] Foreign Application Priority Data

Aug. 7, 1986 [JP] Japan ..... 61-184139

[51] Int. Cl.[4] ..... D01F 9/22

[52] U.S. Cl. ..... 264/29.2; 264/83; 264/130; 264/182; 264/210.8; 264/211.15; 264/233

[58] Field of Search ..... 264/29.2, 129, 182, 264/83, 203, 206, 211.15, 211.16, 211.17, 233, 234, 342 R, 342 RE, 345, 130

[56] References Cited

U.S. PATENT DOCUMENTS 2,883,260 4/1959 Melchore et al. ..... 264/182

3,514,512 5/1970 Kikuchi et al. ..... 264/342 RE

FOREIGN PATENT DOCUMENTS 58-13714 1/1983 Japan .

61-97477 5/1986 Japan .

*Primary Examiner*—Hubert Lorin

*Attorney, Agent, or Firm*—Sughrue, Mion, Zinn, Macpeak & Seas

[57] ABSTRACT

A method for manufacturing carbon fiber strand from an acrylic polymer by steps of (a) wet spinning, (b) washing with water to obtain gelled fiber strand and (c) drying, wherein during the drying step the gelled fiber strand is shrunk by about 5 to 15% when the water of the gelled fiber strand is within a range of from about 100 to 20% by weight based on the weight of the dry fiber strand. An acrylic fiber strand without coalescence or entangling of filaments can consistently be obtained, from which carbon fibers with high quality and substantially no coalescence can be produced.

11 Claims, No Drawings

METHOD FOR PRODUCING CARBON FIBERS FROM ACRYLONITRILE FIBER STRANDS

FIELD OF THE INVENTION

The present invention relates to a method for manufacturing acrylic fiber strands which can be used as raw fiber materials for manufacturing carbon fibers.

The acrylic fiber strands obtained by the present invention having substantially no coalescence are extremely useful as raw fiber materials for manufacturing carbon fibers.

BACKGROUND OF THE INVENTION

Previously, acrylic fiber strands have been widely known and put to practical use as raw fiber materials for manufacturing carbon fibers.

Acrylic fiber strands for manufacturing carbon fibers are manufactured from polymers containing at least 90% by weight or more, preferably 95% by weight or more, of acrylonitrile through the steps of spinning, stretching and drying.

As the spinning solvent, organic solvents such as dimethylformamide (DMF), dimethylsulfoxde (DMSO), dimethylacetamide (DMA), etc., and inorganic solvents such as zinc chloride, nitric acid, rhodanate, etc. are used. In particular, as the spinning solvent for acrylic fiber strands to be used for manufacturing carbon fibers, a zinc chloride-containing aqueous solution is preferred and can be used efficiently.

One important factor affecting the quality of the acrylic fiber strands for manufacturing carbon fibers is the problem of coalescence of filaments. The degree of coalescence varies from a state in which the filaments are lightly adhered to one another to a state in which two or several of the filaments are integrated with no boundary. Such coalescence of the filaments results in fiber breakage during the manufacturing carbon fibers, causing fluff on the strand, and lowering the strand strength, and accordingly causes problems in the stability of the manufacturing steps and the quality of the fiber products. Therefore, it is extremely important to manufacture coalescence-free acrylic fiber strands for manufacturing carbon fibers.

In general, in the wet spinning of acrylic fiber strands, the steps of spinning, solvent removal, post-stretching, drying, etc, are carried out, and in the case of acrylic fiber strands for manufacturing carbon fibers, the strength of the raw fiber materials often has a great influence on the strength of the resulting carbon fibers. Accordingly, the acrylic fiber strands for manufacturing carbon fibers are highly stretched during manufacture in most cases, whereby fiber products having high molecular orientation are generally obtained. Further, since the acrylic fiber strands for manufacturing carbon fibers are intermediate fibers in the course of manufacturing the carbon fibers, these do not always require the relaxation (shrinking) treatment which is generally applied to acrylic fiber strands for general use (e.g., fabrics), in a degree of about 30% after completion of drying for the purpose of improving the knot strength. This is because the relaxation treatment would cause the relaxation of molecular orientation, which is unfavorable for raw materials for manufacturing carbon fibers, which are required to have a high strength.

On these grounds, the running fiber strands are in most cases subjected to manufacturing steps under a tension which would not permit the relaxation of the molecular orientation, during the manufacturing steps of the fibers.

However, if acrylic fiber strands for manufacturing carbon fibers are manufactured under such conditions, the coalescence of the fibers frequently occurs, and the coalescence of the raw fiber materials causes breakage or combustion of the fiber strands during a preoxidation process, and further reducing the quality of the final carbon fiber products.

During manufacture of acrylic fiber strands for manufacturing carbon fibers, a system has been adopted for increasing productivity that includes arranging plural strands parallel to one another, passing them through manufacturing steps in the form of a sheet, and thereafter separating the sheet of strands into individual strands. In this case, the strands must not be entangled, so they can be easily separated in the last separation step. However, the filaments are often loosened and become entangled with the strands during the manufacturing steps, and as a result, separation becomes difficult and the strands often become fluffy.

SUMMARY OF THE INVENTION

An object of the present invention is to solve the above-mentioned problems and to manufacture acrylic fiber strands suitable for manufacturing carbon fibers without coalescence that have excellent manufacturing stability (e.g., do not undergo breakage of the strands), as raw fiber materials for use in manufacturing carbon fibers.

Another object of the present invention is to provide a process for manufacturing acrylic fiber strands suitable for manufacturing carbon fiber, in which the fiber strands do not become entangled.

The present invention provides a method for manufacturing acrylic fiber strands from an acrylic polymer by steps of (a) wet spinning, (b) washing with water to obtain gelled fiber strands and (c) drying, wherein during the drying step the gelled fiber strand is shrunk by about 5 to 15% when the water of the gelled fiber strand is within a range of from about 100 to 10% by weight based on the weight of the dry fiber strand.

DETAILED DESCRIPTION OF THE INVENTION

In the present invention the degree of shrinkage ($\Delta l$)is defined by the following formula $$\Delta l = \frac{l - l'}{l} \times 100(\%)$$

wherein l is the fiber length before shrinking and l' is the fiber length after shrinking.

In accordance with the present invention, raw fiber materials which are free from fiber coalescence and which can be used for manufacturing acrylic carbon fibers having high strength can consistently be obtained.

In the present invention, the term "acrylic fiber strands" means fiber strands made of an acrylic polymer (i.e., at least one of homopolymers and copolymers) preferably containing about 90% by weight or more, and more preferably about 95% by weight or more, of acrylonitrile, and in the present case, any vinyl monomers which are copolymerizable with acrylonitrile can be used as the comonomers. For instance, known comonomers can be used, including neutral monomers such as methyl acrylate, methyl methacrylate and vinyl acetate; acrylic acid, methacrylic acid, itaconic acid, maleic acid, vinylsulfonic acid, allylsulfonic acid, methallylsulfonic acid, styrenesulfonic acid and metal salts thereof (such as the sodium salt and potassium salt) and ammonium salts; vinylimidazole, vinylpyrimidine and derivatives thereof; and acrylamide, methacrylamide, etc. The preferred molecular weight of the polymer is about 40,000 to 200,000, more preferably about 60,000 to 80,000.

The solvent for use in the wet spinning step, includes organic solvents such as DMF, DMSO, DMA, etc., and inorganic solvents such as zinc chloride, nitric acid, rhodanate, etc. In particular, as the spinning solvent for acrylic fibers used for manufacturing carbon fibers, a zinc chloride-containing aqueous solution is preferred.

The zinc chloride-containing aqueous solution is an aqueous solution containing zinc chloride in a concentration sufficient for dissolving the above-mentioned acrylic polymer (usually, 53 to 60%, preferably 54 to 59%), and this can be a concentrated aqueous solution containing only zinc chloride or a mixture of zinc chloride and other inorganic salt(s) such as sodium chloride, calcium chloride, magnesium chloride, ammonium chloride, etc., which other salt is incorporated in an amount of about 0 to 50% by weight based on the total weight of the salts in the solution.

The preparation of the spinning solution can be carried out by conventional means, including, for example, a polymer dissolution method or a solution polymerization method. Generally, a spinning solution having a polymer concentration of from about 3 to 15% by weight, preferably from about 5 to 8% by weight, is used when the zinc chloride-containing aqueous solution is used as the solvent.

When the zinc chloride-containing aqueous solution is used as the spinning solvent, the spinning is carried out with the spinning nozzle as described, for example, in Japanese Pat. application (OPI) No. 13714/83 (the term "OPI" as used herein refers to a "published unexamined Japanese patent application"), whereby the spinning solution is wet-spun into a coagulant bath having the same composition as the solvent with a relatively low concentration, for example, of from about 10 to 40% by weight.

Spinning is conducted so that a fiber strand generally having from about 100 to 30,000 filaments is obtained.

The fiber material is spun under the spinning conditions of, for example, a coagulant bath temperature of from about 0° to 15° C., an injecting rate of from about 10 to 30 m/min and a draft ratio of from about 20 to 35%, and the gelled fiber thus obtained is washed with water for removal of solvent until a remaining salt concentration of about 0.1% by weight or less is reached, whereupon the fiber is stretched to 2 to 4 times its original length.

Generally, the gelled fiber strand is treated with an oiling agent in order to prevent coalescence of filaments in the strand. Examples of the oiling agent include silicon oils represented by the following formula (I) (disclosed in Japanese Patent Application (OPI) No. 218507/84 corresponding to U.S. patent application Ser. No. 789,243) and ammonium salts of fatty esters and amides represented by the following formulae (II) and (III), respectively (disclosed in U.S. Pat. No. 4,536,448).

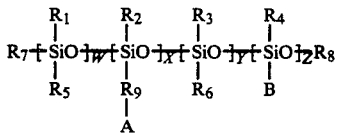

wherein $R_1$, $R_2$, $R_3$, $R_4$, $R_5$ and $R_6$ each represents a lower alkyl group or an aryl group, $R_7$ represents a hydrogen atom, a lower alkyl group or an aryl group, $R_8$ represents H, $-CH_3$, or $-\overset{\overset{R_{10}}{|}}{\underset{\underset{R_{12}}{|}}{Si}}-R_{11}$ $R_{11}$ and $R_{12}$ each represents a hydrogen atom, a lower alkyl group or an aryl group), $R_9$ represents an alkylene group having at most 5 carbon atoms, an arylene group, or a single bond, group $-N\begin{matrix}R_{13}\\R_{14}\end{matrix}$ (wherein $R_{13}$ and $R_{14}$ each represents H, $-CH_3$, $-C_2H_5$), B represents a group $-(CH_2CH_2O)_m(CH_2\underset{\underset{CH_3}{|}}{C}HO)_nR_{15}$ (wherein $R_{15}$ represents H Or $-CH_3$, and m and n each represents 0 or an integer of from 1 to 10, provided that $m+n \geqq 1$), X and Z each represents an integer of 1 or more, and W and Y each represents 0 or an integer of 1 or more.

The lower alkyl group in formula (I) preferably is an alkyl group having from 1 to 4 carbon atoms, and it may be a straight chain or branched chain alkyl group, and is preferably a straight chain group. The aryl and arylene groups in formula (I) are preferably a phenyl group and a phenylene group, respectively.

The gelled fiber is preferably treated with a polyoxyalkylene aminopolysiloxane compound of formula (I) wherein (a) the amino group (A) in a side chain accounts for from about 0.5 to 1.5% by weight of the molecule, (b) the polyoxyalkylene group (B) in the side chain accounts for from about 5 to 15% by weight of the molecule, or wherein both groups (A) and (B) satisfy the respective requirements (a) (b). and Z in formula (I) is suitably determined depending on the amounts of the amino group (A) and the polyoxyalkylene group (B) in the molecule, respectively, and W and Z are determined depending on the necessary viscosity of the oiling agent. The viscosity is preferably from about 5 to 500 poises at 25° C.

$$\left[R_{21}COOCH_2CH_2N\begin{matrix}R_{22}\\R_{23}\\CH_2CH_2OH\end{matrix}\right]^{\oplus} X^{\ominus} \quad \text{(II)}$$

-continued

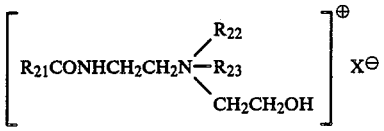

(III)

In formulae (II) and (III), $R_{21}$ is an aliphatic hydrocarbon group having from 11 to 17 carbon atoms, and preferably is a linear saturated aliphatic hydrocarbon group; R22 and R23 are each hydrogen, a lower alkyl group preferably having from 1 to 3 carbon atoms such as a methyl group, an ethyl groups, a hydroxyethyl group and a hydroxyisopropyl group; and X is an anion, such as a chlorine ion, an acetate ion, a lactate ion, a phosphate ion, sulfate ion, a borate ion, a nitrate ion, and a phosphoryl dioxy ethanol ion.

The oiling agents represented by formulae (I), (II) and (III) can be used alone or in a combination of two o more.

Such an oiling agent is applied to the fiber preferably in an amount of from about 0.01 to 0.3 % by weight, more preferably, about 0.03 to 0.1 % by weight based on the weight of the polymer. The oiling agent is applied to the fibers by immersing the strands in a solution or a dispersion of he oiling agent or by spraying a solution or dispersion of the oiling agent on the strands.

The stretching of the fiber is carried out before and/or after subjecting the fiber to a drying process, whereby the fiber is stretched in general to about 5 to 30, preferably about 8 to 15 times the length of the fiber immediately after the fiber is removed from the coagulating bath (i.e., immediately after spinning).

To perform the stretching, hot water, steam, heated air, a heated roller or the like can be used.

In stretching before drying, water is used as the stretching medium, and it is preferred that the fiber be stretched to about 2 to 4 times its original length at a temperature of from about 15 to 90° C. The stretching after drying is conducted at a temperature of from about 80° to 250° C. For example, hot water having a temperature of from about 80° to 100° C., steam having a steam pressure of from 0.4 to 1.2 $Kg/cm^2$ (gauge), heated air having a temperature of from about 140° to 250° C., or a heated roller having a temperature of from about 140° to 250° C. is used as the stretching medium, and it is preferred that the fiber is stretched to about 2 to 6 times its original length.

In any case, the thus wet-spun strand is dried, and the drying conditions have an important influence on the coalescence of the fiber product obtained. Specifically, the gelled fiber strand immediately after wet-spinning generally has a water content of about 400% by weight or more based on the weight of the dried fibers. The strand is deswellen with the progress of molecular orientation when it is stretched during washing with water, and after washing, the strand has a water content of about 160% by weight or so based on the weight of the dried fibers.

The drying of fibers containing water is usually conducted at from about 50° to 180° C., preferably at from about 50° to 150° C. The drying temperature is preferably raised as the drying proceeds.

The drying frequently causes the coalescence of the fibers, as the gelled fibers are heated, and the coalescence often causes extreme reduction in the quality of the raw fiber materials and further in the quality of the carbon fibers derived therefrom.

Accordingly, in the present invention, the gelled fiber strands having a water content of from about 100 to 10%, preferably about 80 to 20% by weight based on the weight of the dried fibers are dried while being shrunk by about 5 to 15%, preferably by about 5 to 10 % at any step during the drying so long as the water content of the fibers is within the above-described range, and then the fibers are further dried, preferably, to a substantial water content of 0% by weight, and preferably under tension, whereby the coalescence of the fibers can be prevented and fibers which are excellent as raw fiber materials for manufacturing carbon fibers can be obtained. When the shrinking is conducted prior to reaching a water content of about 100% or after reaching about 10% acrylic fiber having reduced coalescence can not be obtained. On the other hand, when the shrinkage is less than about 5% acrylic fiber having substantially no coalescence can not be obtained, and when the shrinkage is more than about 15%, entangled acrylic fibers are obtained.

In the step of drying the gelled fiber strands having a water content of from about 100 to 10% by weight, drying roller system, suction drum system or the like can be used as the drying means, and in particular, a hot air-drying system with suction drum is preferred in view of operating efficiency.

During the drying process the fibers are kept under sufficient tension to control the change of the fiber length within a range of from about 0±5%, preferably at the constant fiber length, until the water content becomes 100%.

The filament diameter of the thus obtained acrylic fiber usually is from about 1 to 8 denier.

According to the method of the present invention as described above, coalescence-free acrylic fiber strands can be obtained. The effect of the present invention is shown by the following experiment, which was carried out in the same manner as Example 1.

TABLE 1

| Water Content in Strand During Drying Step (wt. %) | Shrinkage (%) | Evaluation Coalescence (number) (*) | Entangling (**) |
|---|---|---|---|
| 120<-140 | 7 | 30-70 | Present |
| 100<-120 | 7 | 10-30 | Present |
| 80-100 | 7 | 10 or less | Absent |
| 60-80 | 7 | 0 | Absent |
| 40-60 | 7 | 0 | Absent |
| 20-40 | 7 | 0 | Absent |
| 10-20 | 7 | 3 or less | Absent |
| 0-<10 | 7 | 3-10 | Present |

Note:
(*)The strand was cut to 1 m length and dried at room temperature, and then separated by slight vibration, and the number of the coalesced strands was counted.
(**)The strand taken out from the dryer was divided with 3 mm diameter needles, and the number of the filaments entangled over the strand was observed.

TABLE 2

| Shrinkage (%) | Water Content (wt. %) | Evaluation Coalescence (number) | Entangling |
|---|---|---|---|
| Stretched | | | |
| −4 | 30-40 | 100-200 | Absent |
| −2 | | 70-100 | Absent |
| Nomal | | | |
| ±0 | 30-40 | 10-50 | Absent |
| Shrinkage | | | |
| +5 | 30-40 | 0 | Absent |
| +10 | 30-40 | 0 | Absent |

TABLE 2-continued

| Shrinkage (%) | Water Content (wt. %) | Evaluation Coalescence (number) | Entangling |
|---|---|---|---|
| +13 | 30–40 | 0 | Absent |
| +15 | 30–40 | 0 | Absent |
| +17 | 30–40 | 0 | Present |
| +20 | 30–40 | 0 | Present |

Note:
(*)The evaluation of "coalescence" and "entangling" was the same as in Table 1.

The acrylic fiber strand of the present invention is subjected to carbonization. Carbonization of the acrylic fiber strand may be conducted according to conventional methods which are disclosed, for example, in U.S. Pat. Nos. 4,069,297, 4,073,870, 4,187,279 and 4,543,241.

In the production of carbon fiber strand the acrylic fiber strand is subjected to a preoxidation treatment at a temperature of about 200° to 300° C. in an oxidizing atmosphere to obtain a preoxidized fiber strand, and then the thus obtained preoxidized fiber strand is carbonized at about 500° to 2,000° C. or higher (up to about 3,000° C. to obtain a graphite fiber strand) in an inert gas atmosphere. Carbon fiber strands having high quality can be produced consistently using acrylic fiber strands of the present invention.

The following examples are intended to illustrate the present invention but are not to be construed as limiting it in any way. Unless otherwise indicated, all parts, ratios and percentages(%) are by weight.

EXAMPLE 1

A spinning solution obtained by solution polymerization in 59% zinc chloride aqueous solution, which produced a polymer composition of 97% acrylonitrile and 3% methyl acrylate, having a molecular weight of 75,000 and a polymer concentration of 7.5% was injected through a spinning nozzle with 12,000 holes (diameter 0.065mmΦ) into a 30% zinc chloride aqueous solution and coagulated therein, and then washed with water until the remaining salt become less than 0.05%, stretched at a draw ratio of 3.2 during the washing and coated by dipping with an oil agent shown below to adhere the oil in an amount of 0.07 wt% based on the weight of the polymer to obtain strands with a water content of 160%.

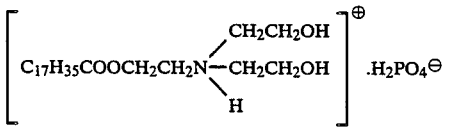

20 strands of the acrylic fibers thus obtained were spread in a width of 40 mm with no interval to form a sheet, and the resulting sheet was passed through a dryer having 8 suction drums as arranged in series. Drying was conducted at a temperature which was gradually elevated from 70° to 140° C. The rotation speed of each drum, degree of shrinkage, and the water content in the strand sheet in each drum are shown in the following Table 3. The acrylic fiber strands thus obtained were not coalesced, and in addition, the strands were not entangled.

The acrylic fiber strands were stretched at a draw ratio of 4.5 in saturated steam at 0.6 kg/cm$^2$ (gauge) at a temperature of 113° C., to produce raw fiber materials for manufacturing carbon fiber strands of 12,000 filaments, which had a filament fineness of 0.9 denier and a filament tensile strength of 8.6 g/d. (d: denier)

The thus obtained acrylic fiber strands were heated at 260° C. for 1.5 hours in air under a tension of 30 mg/denier to obtain preoxidized fiber strands. The preoxidized fiber strands were then carbonized at 1400° C. for 1 minute in a nitrogen stream under a tension of 30 mg/denier.

The carbon fiber strands thus obtained were not coalesced and had a tensile strength of 450 kgf/mm$^2$ and a tensile modulus of elasticity of 25,000 kgf/mm$^2$.

TABLE 3

| Drum No. | Rotation Speed (M/min) | Water Content (%) (Water content at the dryer inlet mouth was 160%) | Shrinkage (%) |
|---|---|---|---|
| 1 | 20.0 | 100 | 3 |
| 2 | 19.4 | 60 | 6 |
| 3 | 18.8 | 35 | 10 |
| 4 | 18.0 | 18 | 7 |
| 5 | 18.6 | 10 | 3.5 |
| 6 | 19.3 | 0 | 0 |
| 7 | 20.0 | 0 | 0 |
| 8 (Dryer outlet mouth) | 20.0 | 0 | 0 |

COMPARATIVE EXAMPLE 1

For comparison, the process of Example 1 was repeated except that the rotation speed of each drum was changed to that shown in the following Table 4. As a result, the strands after drying were noticeably entangled and the separation of the entangled strands was difficult.

TABLE 4

| Drum No. | Rotation Speed (M/min) | Water Content (%) (Water content at the dryer inlet mouth was 160%) | Shrinkage (%) |
|---|---|---|---|
| 1 | 20.0 | 100 | 5 |
| 2 | 19.0 | 60 | 15 |
| 3 | 17.0 | 35 | 20 |
| 4 | 16.0 | 18 | 17 |
| 5 | 16.6 | 10 | 17 |
| 6 | 16.6 | 0 | 17 |
| 7 | 16.6 | 0 | 17 |
| 8 | 16.6 | 0 | 17 |
| | (Dryer outlet mouth) | | |

While the invention has been described in detail and with reference to specific embodiments thereof, it will be apparent to one skilled in the art that various changes and modifications can be made therein without departing from the spirit and scope thereof.

What is claimed is:

1. A method for manufacturing a carbon fiber strand from an acrylic polymer wherein said carbon fiber has high strength and substantially no coalescence, by steps of (a) wet spinning, (b) washing with water to obtain gelled fiber strand and (c) drying to form an acrylic fiber strand, wherein during the drying step the gelled fiber strand is shrunk by about 5 to 15% when while maintaining the water content of the gelled fiber strand within a range of from about 100 to 20% by weight based on the weight of the dry fiber strand, (d) subjecting the acrylic fiber strand to a preoxidation treatment at a temperature of about 200° to 300° C. in an oxidizing atmosphere to obtain a preoxidized fiber strand, and (e) subjecting the preoxidized fiber strand to a carbonizing treatment at a temperature of about 500 to 3000? C. in an inert gas atmosphere.

2. A method as in claim 1, wherein said carbonizing treatment temperature is from 500° to 2000° C.

3. A method as in claim 1, wherein the acrylic fiber comprises an acrylic polymer comprising at least about 90% by weight of an acrylonitrile monomer.

4. A method as in claim 1, wherein said drying step is conducted at a temperature of from about 50° to 180° C.

5. A method as in claim 1, wherein said water content is within a range of from about 80 to 20% by wight during said shrinking.

6. A method as in claim 1 , comprising the further step of stretching said strand to about 5 to 30 times the length of the strand immediately after spinning.

7. A method as in claim 1, comprising the further step of applying an oiling agent to said strand prior to said drying step.

8. A method as in claim 1, wherein said spinning is conducted so that a fiber strand having from about 100 to 30,000 filaments is obtained.

9. A method as in claim 1, comprising the further step of stretching said fiber strand to about 2 to 4 times the length of the strand before subjecting said fiber strand to said drying step.

10. A method as in claim 1, comprising the further step of stretching said fiber strand to about 2 to 6 times the length of the strand after subjecting said fiber strand to said drying process.

11. A method as in claim 1, wherein said acrylic fiber strand has a filament diameter of from about 1 to 8 denier.

* * * * *